US006398878B1

(12) United States Patent
Henkin et al.

(10) Patent No.: US 6,398,878 B1
(45) Date of Patent: Jun. 4, 2002

(54) AUTOMATIC POOL CLEANER INCLUDING MOTION SENSOR AND REPOSITIONING MEANS

(76) Inventors: Melvyn L. Henkin, 1001 Sharon La.; Jordan M. Laby, 1389 Beachmont, both of Ventura, CA (US) 93001

( * ) Notice: Subject to any disclaimer, the term of this patent is extended or adjusted under 35 U.S.C. 154(b) by 0 days.

(21) Appl. No.: 09/557,978

(22) Filed: Apr. 25, 2000

Related U.S. Application Data

(63) Continuation-in-part of application No. PCT/US98/27623, filed on Dec. 23, 1998, and a continuation-in-part of application No. PCT/US98/27622, filed on Dec. 23, 1998, and application No. 08/998,529, filed on Dec. 26, 1997, now Pat. No. 6,039,886, and application No. 08/998,528, filed on Dec. 26, 1997, now Pat. No. 6,090,219, and application No. PCT/US97/11302, filed on Jun. 25, 1997, and application No. PCT/US97/07742, filed on May 6, 1997.

(51) Int. Cl.[7] ..... B08B 3/02

(52) U.S. Cl. ..... 134/18; 134/21; 134/167 R; 15/319; 15/1.7; 210/776

(58) Field of Search ..... 134/21, 18, 22.12, 134/24, 167 R, 168 R; 15/319, 1.7; 210/143, 776

(56) References Cited

U.S. PATENT DOCUMENTS 3,291,145 A * 12/1966 Arneson
3,676,885 A * 7/1972 Wule
3,718,148 A * 2/1973 Gibellina
3,765,432 A * 10/1973 Goodin
3,796,373 A * 3/1974 Moore
4,007,749 A * 2/1977 Pansini
4,786,334 A * 11/1988 Nystrom
5,435,031 A * 7/1995 Minami et al.
5,507,058 A * 4/1996 Minami et al.

* cited by examiner

*Primary Examiner*—Frankie L. Stinson
(74) *Attorney, Agent, or Firm*—Freilich, Hornbaker & Rosen

(57) ABSTRACT

An automatic swimming pool cleaning system including a cleaner body intended to travel in a forward direction along a wall surface or on the water surface to substantially randomly traverse a swimming pool. The system includes a propulsion subsystem for producing a force to propel the body in a forward direction, a motion sensor for indicating when the velocity of the body, diminishes below a certain threshold rate, and a repositioning subsystem responsive to said motion sensor indication for producing a limited duration force to change the position of the body after which forward direction motion resumes.

47 Claims, 9 Drawing Sheets

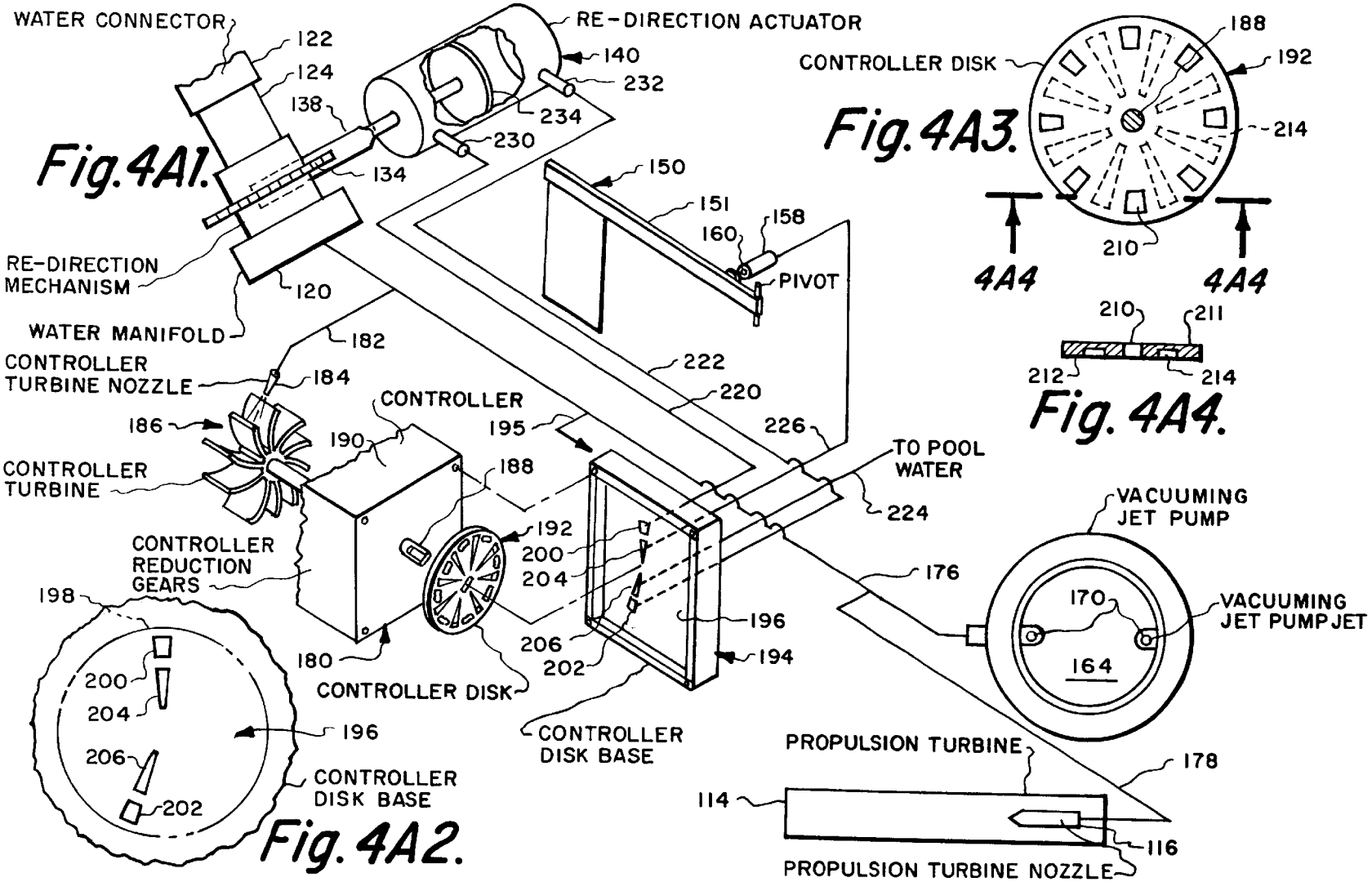
Fig. 4A1.
Fig. 4A2.
Fig. 4A3.
Fig. 4A4.

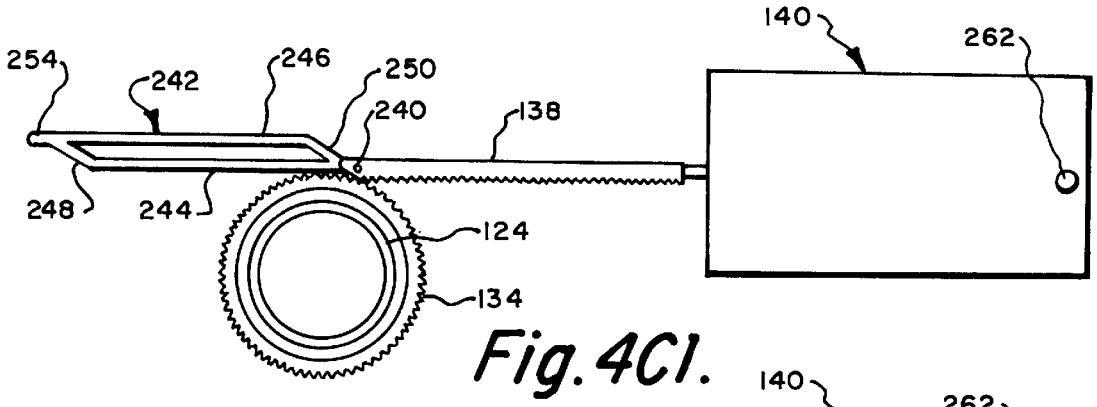
Fig. 4C1.
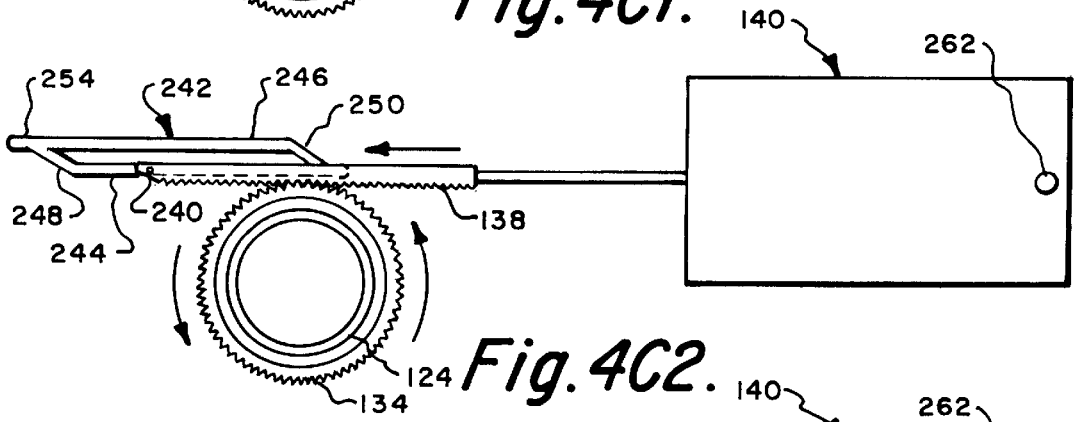
Fig. 4C2.
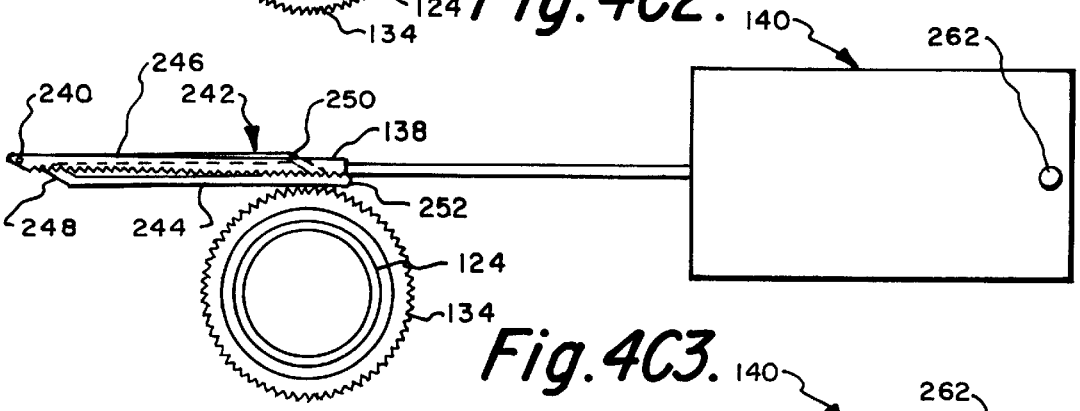
Fig. 4C3.
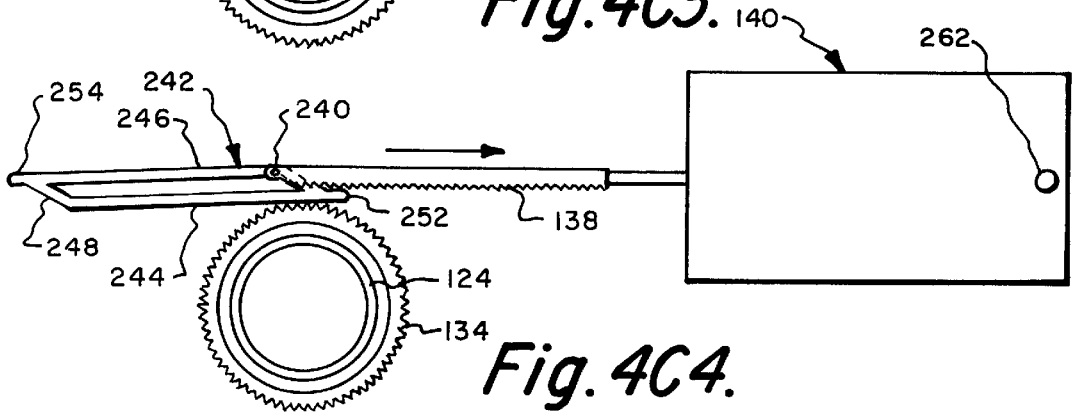
Fig. 4C4.

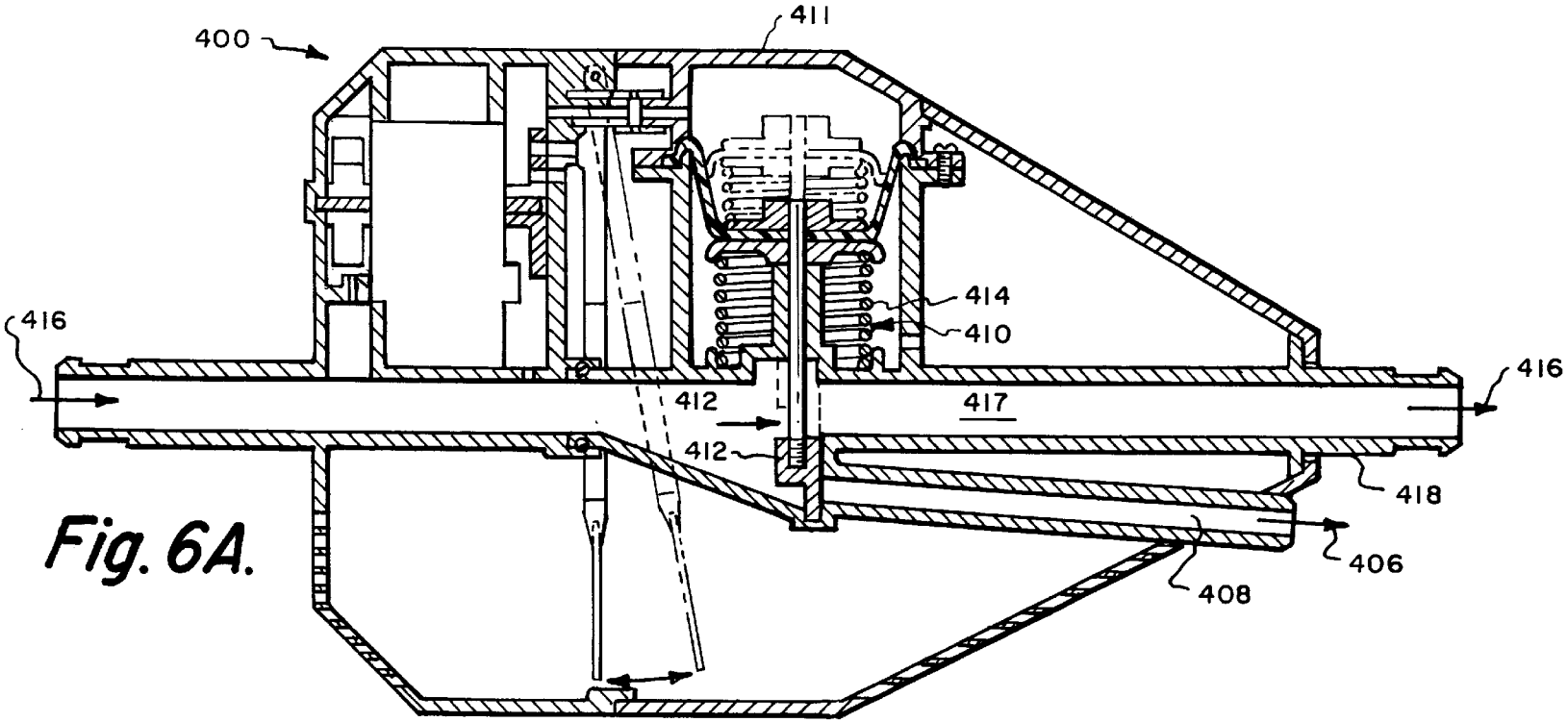
Fig. 6A.
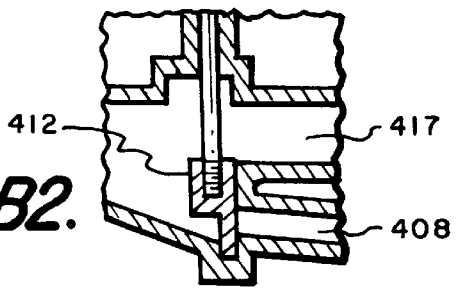
Fig. 6B2.
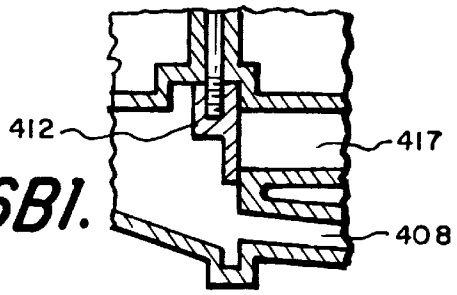
Fig. 6B1.

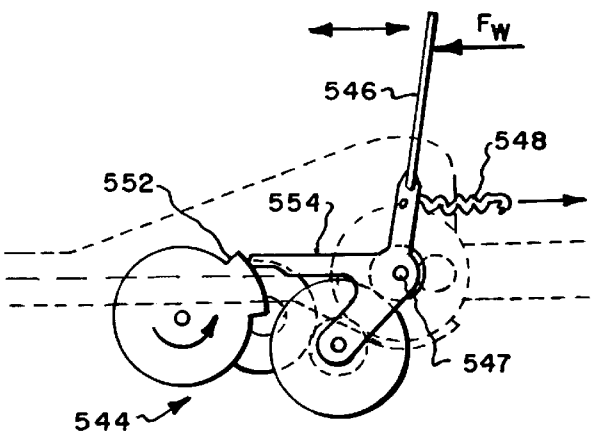
Fig. 7B.
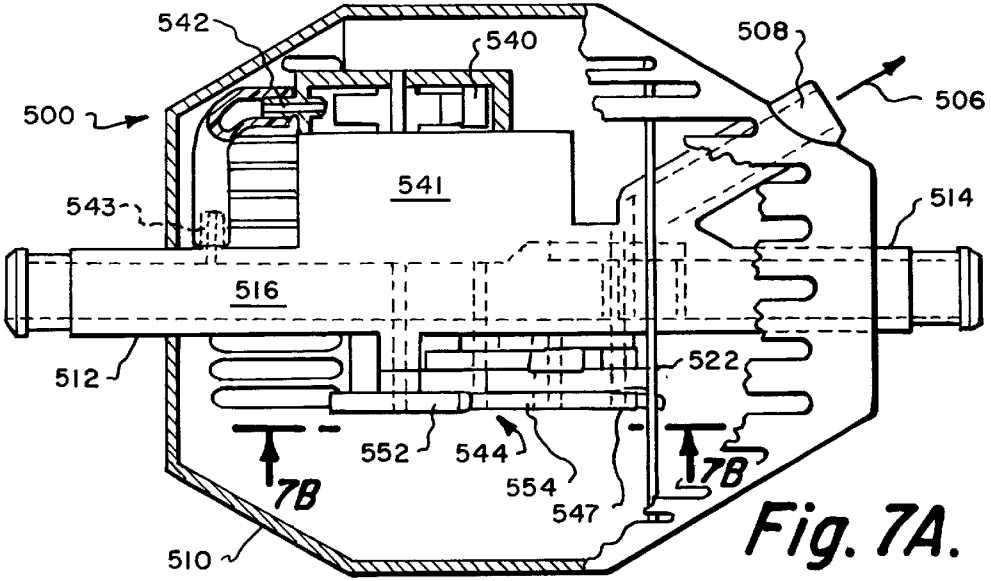
Fig. 7A.
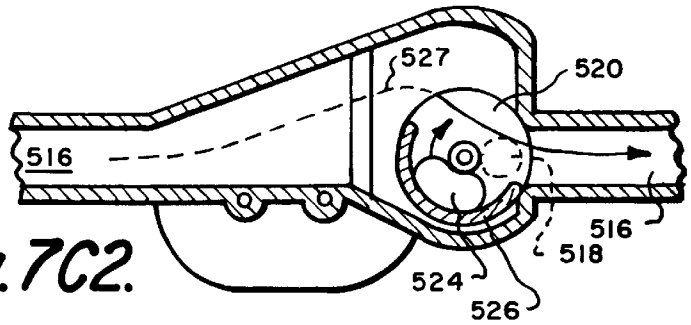
Fig. 7C2.
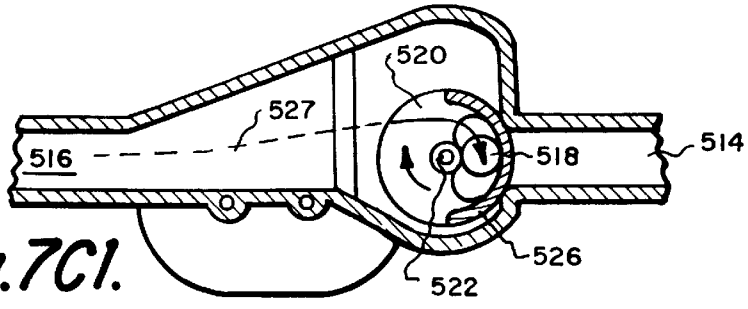
Fig. 7C1.

AUTOMATIC POOL CLEANER INCLUDING MOTION SENSOR AND REPOSITIONING MEANS

RELATED APPLICATIONS

This application is a continuation-in-part of:

(1) International Application PCT/US97/07742 filed May 6, 1997, U.S. application Ser. No. 08/998528 filed Dec. 26, 1997, now U.S. Pat. No. 6,090,219, and International Application PCT/US98/27623 filed Dec. 23, 1998; and (2) International Application PCT/US97/11302 filed Jun. 25, 1997, U.S. application Ser. No. 08/998529 filed Dec. 26, 1997, now U.S. Pat. No. 6,039,886, and International Application PCT/US98/27622 filed Dec. 23, 1998.

The disclosures of the aforecited applications are incorporated herein by reference.

BACKGROUND OF THE INVENTION

This invention relates generally to automatic swimming pool cleaners of the type which use a cleaner body for movement through a water pool to remove dirt from the water and/or containment wall surfaces. Various pool cleaner configurations are shown in the prior art including cleaners that are powered by positive pressure water flow, negative pressure (i.e., suction) water flow, and electricity to propel a cleaner body forwardly through a water pool. Further, many such pool cleaners include timer mechanisms which periodically initiate a "backup" state to propel the body in a reverse direction. The inclusion of a backup state reduces the likelihood of the body getting trapped behind an obstruction for an extended period.

At least one prior patent, i.e., U.S. Pat. No. 4,100,641 issued to Pansini, describes a cleaner which is propelled in either first or second opposite directions and which responds to the cleaner slowing down or stopping, to switch directions.

The aforementioned International Applications PCT/US98/27623 and PCT/US98/27622 disclose automatic swimming pool cleaning systems respectively powered by positive pressure and negative pressure sources. Both applications disclose multiple embodiments which include a cleaner body carrying a propulsion subsystem for producing a force to propel the body in a forward direction. The actual motion and orientation of the body at any instant in time is determined by the net effect of several forces variably acting on the body, e.g., the propulsion force, drag forces attributable to the power source hose, contact forces exerted by the wall surfaces and obstruction surfaces (e.g., ladder, steps, etc.), etc. As a consequence, the cleaner body typically traverses an essentially random path through the pool as it is propelled in a forward direction by the propulsion force. Although the body is preferably configured so that the propulsion force causes the body to generally glance off or work its way around most obstructions, situations can occur when an obstruction, acting in conjunction with the propulsion force, traps the body in a particular location. In order to avoid such trapping, the aforementioned applications disclose embodiments (e.g., FIGS. 13, 23 in PCT/US98/27623 and FIGS. 22, 26 in PCT/US98/27622) which include a motion sensor which functions to indicate when the body's forward motion diminishes below a certain threshold rate. The motion sensor indication is then used to exert an additional force on the body for a limited duration to change (e.g., rotate and/or translate) the body's position. Thereafter, the propulsion force propels the body forwardly enabling the body to avoid the obstruction and randomly traverse the pool.

Although the embodiments specifically described in the aforecited international applications relate primarily to cleaner bodies capable of selectively operating proximate to both the water surface and wall surface, the concept of sensing cleaner body motion to initiate a limited duration repositioning force is applicable to a wide variety of automatic swimming pool cleaners including cleaners intended to operate (1) solely near the wall surface and (2) solely near the water surface. Such cleaners can be powered by a variety of sources including positive pressure and/or negative pressure hydraulic and pneumatic sources as well as electric power sources. The specific preferred embodiments described herein are primarily intended for use with wall surface cleaner bodies driven by positive water pressure sources.

SUMMARY OF THE INVENTION

The present invention relates to automatic swimming pool cleaning systems including a cleaner body intended to travel in a forward direction to substantially randomly traverse a swimming pool. Systems in accordance with the invention include a propulsion subsystem for producing a force to propel the body in a forward direction, a motion sensor for indicating when the velocity of the body, diminishes below a certain threshold rate, and a repositioning subsystem responsive to said motion sensor indication for producing a limited duration force to change the position of the body.

More particularly, systems in accordance with the invention contemplate that the body travel in a forward direction for extended periods of time. In the event, the motion sensor recognizes that the body's velocity has diminished below a certain threshold, then the repositioning subsystem is activated to apply a repositioning force for a limited duration, e.g., from 1 to 60 seconds, to reposition the body. The repositioning force in accordance with the invention can be produced in various ways; e.g., (1) by discharging a water flow to develop a reactive force or (2) by activating a mechanism to mechanically develop a rotation and/or translation force. The propulsion subsystem can continue to produce the propulsion force during the limited duration repositioning or, alternatively, it can be interrupted.

A repositioning subsystem in accordance with the invention can be implemented in various manners. For example, it can be configured to be housed in the cleaner body or in a housing carried by a conduit supplying power to drive the cleaner body. The conduit, can for example, comprise a hose for carrying water to or from an externally mounted pump. Alternatively, the conduit can contain electric wires for powering a mechanism on board the cleaner body.

A conduit in a typical swimming pool situation is about 20–45 feet in length and can be comprised of multiple elongate sections coupled together. The conduit should be flexible over its length to allow the cleaner body to randomly traverse the pool without excessive restraint being imposed by the conduit. In accordance with preferred embodiments of the present invention, the portion of the conduit connected to the cleaner body, i.e., the distal conduit section, should exhibit sufficient torsional stiffness to enable the cleaner body to reposition (1) by rotating the body relative to the conduit axis or (2) by twisting or tugging the conduit to thereby reposition the cleaner body. As will be described hereinafter, repositioning subsystems for generating these mechanical forces can be located on the cleaner body and/or on the conduit. As will also be described hereinafter, a repositioning force can be generated by discharging a fluid flow from a location on the cleaner body and/or on the conduit.

It is preferable to introduce a short time delay between the motion sensor recognizing diminished velocity and the repositioning subsystem actually producing the repositioning force. This time delay, which can be introduced by component reaction time, enables the system to tolerate short term aberrations without initiating excessive repositioning.

In preferred embodiments of the invention, a device is incorporated to periodically, e.g., every 10–60 seconds, define a conditional repositioning state, which is ignored if the body's velocity exceeds the threshold. However, if the motion sensor indicates that the body's velocity is less than the threshold, concurrently with the conditional repositioning state being defined, then repositioning is initiated for a limited duration, e.g., 1 to 60 seconds, after which forward motion is resumed. An unconditional repositioning state is also preferably defined at a lower rate, e.g., every one to five minutes, for the purpose of repositioning the body regardless of the body's velocity to enhance the randomness of traverse.

In a first preferred embodiment described hereinafter, the motion sensor and repositioning subsystem are mounted on the cleaner body. The motion sensor comprises a paddle mounted to close a bleed port when body velocity exceeds a certain threshold rate. With the bleed port closed, supplied positive pressure holds a repositioning actuator in a forward state. If body velocity diminishes below the threshold rate, the paddle will open the bleed port, allowing supplied positive pressure to switch the actuator to a reposition state. The actuator is configured to rotate the cleaner body with respect to a distal supply hose section. The actuator includes a linear drive member, e.g., a rack, mounted for movement between a first position when in the forward state and a second position when in the reposition state. The rack is engaged with a gear fixed relative to the distal hose section so that movement of the rack from the first position to the second position rotates the cleaner body around the distal section. Inasmuch as this rotation redirects the cleaner body propulsion subsystem, resumed forward motion will generally allow the body to avoid the obstruction which caused its velocity to diminish below threshold.

In a second preferred embodiment described hereinafter, the motion sensor and repositioning subsystem are mounted in a housing carried by the supply hose. Although the motion sensor so mounted responds to the hose velocity, since the hose is being dragged by the powered cleaner body, the hose velocity indirectly indicates cleaner body velocity and so can be used to initiate repositioning. The housing includes elements which functionally correspond to the elements described with respect to the first embodiment. However, instead of the aforementioned actuator to drive a rack, the second embodiment employs a small turbine to drive a gear which twists or rotates a portion of the supply hose distal section connected to the cleaner body. This action transfers a limited duration rotational force to the cleaner body to modify its position. Thereafter, resumed forward propulsion will generally free the body from the obstruction which caused its velocity to diminish below threshold.

In a third preferred embodiment described hereinafter, the motion sensor and repositioning subsystem are also mounted in a housing carried by the supply hose. The housing defines a nozzle for selectively discharging a water flow to produce a reaction force on the supply hose which is physically transferred by the hose to the connected cleaner body. The water flow discharge through the nozzle is controlled by a valve whose position is determined by a periodic controller and the position of a paddle mounted to sense cleaner body velocity. If body velocity diminishes below a certain threshold, the nozzle is caused to discharge a water flow for a limited duration to reposition the body. Thereafter, forward motion is resumed which will generally allow the body to resume its random traverse of the pool.

A fourth preferred embodiment described hereinafter is also configured for mounting on a housing carried by the supply hose. Similarly to the third embodiment, the fourth embodiment housing defines a nozzle for selectively discharging a water flow to produce a reaction force on the supply hose. This reaction force is physically transferred by the supply hose to the cleaner body to reposition it. The valving to control the discharge in the fourth embodiment is implemented differently from the third embodiment, as well as the controller mechanism for responding to the motion sensor.

DESCRIPTION OF THE FIGURES

FIG. 4A1 schematically shows details of a preferred control system used in the embodiment of FIGS. 3A and 3B to achieve body rotation, FIGS. 4A2 and 4A3, show enlarged detail of structure within the system of FIG. 4A1, and FIG. 4A4 is a sectional view taken substantially along the plane 4A4—4A4 of 4A3;

FIG. 4B is an isometric view showing a preferred mechanism for rotating the cleaner body and FIGS. 4C1, 4C2, 4C3, 4C4 are schematic illustrations for explaining the operation of FIG. 4B;

FIG. 5A depicts a side sectional view of a second embodiment of the invention intended to be carried by the supply hose and including a mechanism to mechanically reposition a connected cleaner body;

FIGS. 5B and 5C respectively depict a periodic control device and a paddle used in the embodiment of FIG. 5A and FIGS. 5D1 and 5D2 depict the two respective positions of a valve member;

FIG. 6A depicts a side sectional view of a third embodiment of the invention intended to be carried by the supply hose using a discharged water stream for repositioning a connected cleaner body and FIGS. 6B1 and 6B2 depict the two respective positions of a valve member;

FIG. 7A, depicts a side sectional view of a fourth embodiment of the invention intended to be carried by the supply hose and using a discharged water stream for repositioning a connected cleaner body; and FIG. 7B is a sectional view taken substantially along plane 7B—7B of FIG. 7A and FIGS. 7C1 and 7C2 depict two respective positions of a valve used in FIG. 7A to selectively direct water flow for repositioning.

DETAILED DESCRIPTION

Figure 1A:
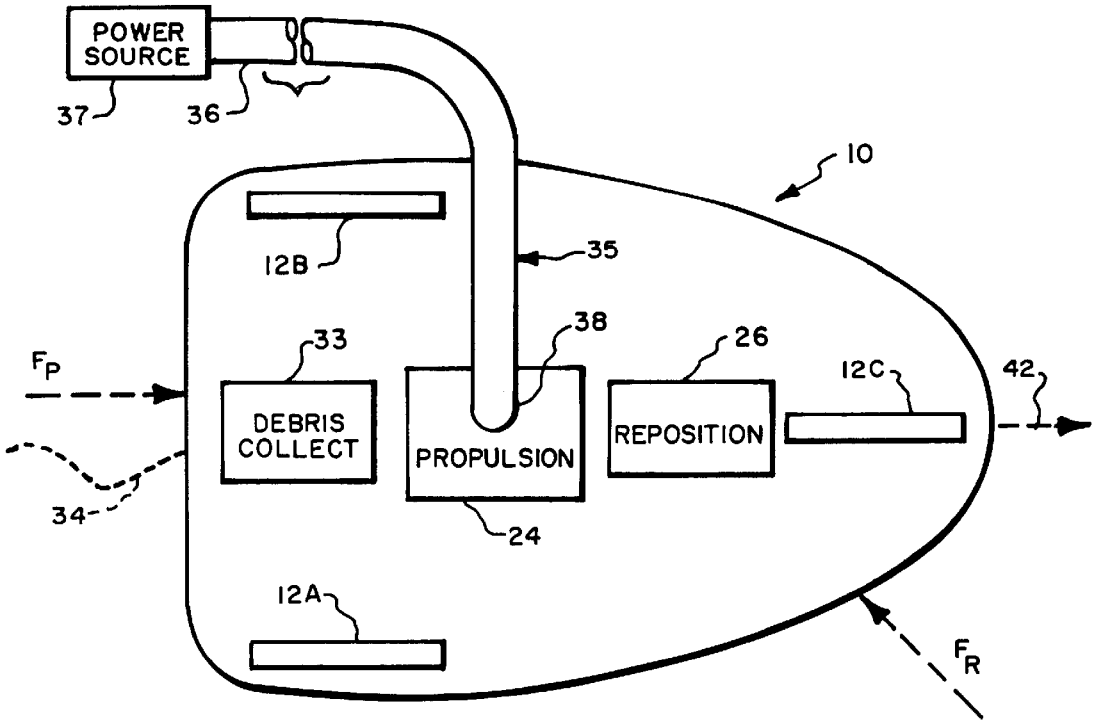
FIGS. 1A and 1B comprise top and side schematic representations of an automatic pool cleaning system in accordance with the invention showing a reposition subsystem located in the cleaner body.
Figure 1B:
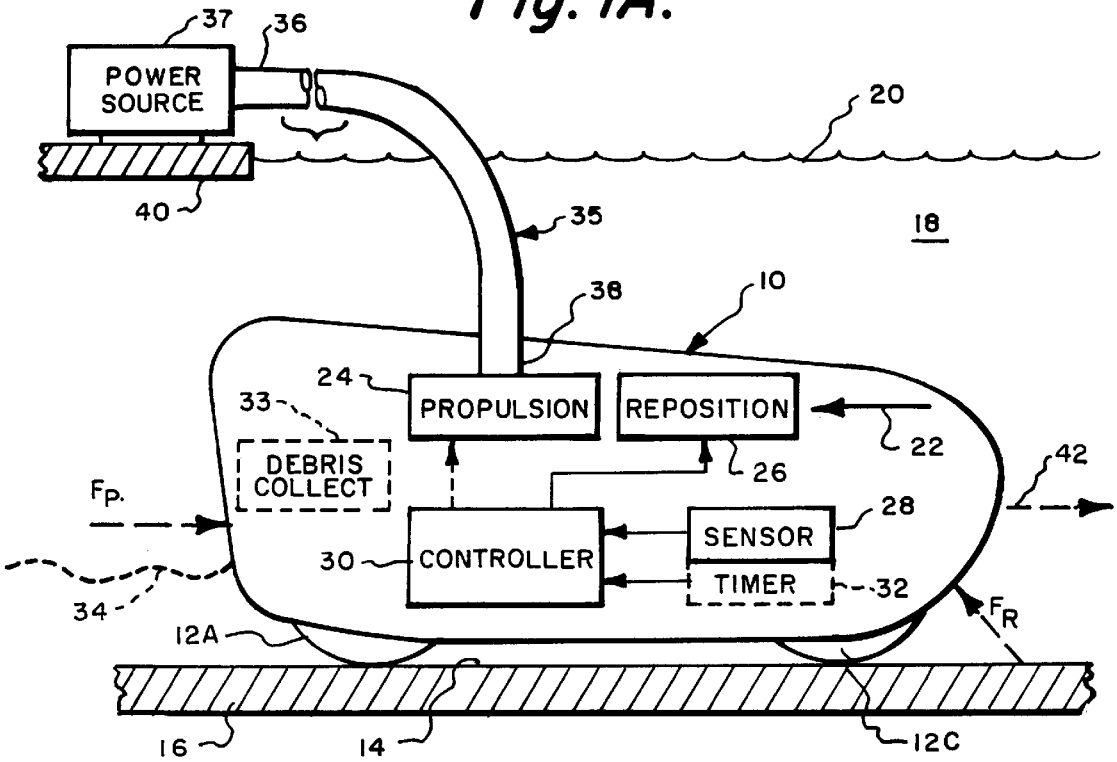

Attention is now directed to FIGS. 1A, 1B which schematically depict a system in accordance with the invention used in conjunction with a cleaner body 10. The body 10 includes traction means, shown as wheels 12A, 12B, 12C, for contacting the surface 14 of a pool containment wall 16 (which should be understood to include bottom and side wall portions). The water pool 18 and the pool water surface 20 are also represented in FIG. 1B.

FIG. 1B depicts a system 22 in accordance with the invention, in block diagram form, for propelling the body 10 along the wall surface 14 to enable it to essentially randomly traverse the pool. The system 22 is comprised of a propulsion subsystem 24, a reposition subsystem 26, a motion sensor 28, a controller 30 and optional elements including a timer 32, a debris collection means 33, and a sweep hose 34. FIG. 1B further depicts a conduit 35 having a first proximal end 36 coupled to a power source 37, mounted externally to the pool such as on deck 40, and a second distal end 38 coupled to body 10 and more specifically to the propulsion subsystem 24. In accordance with the invention, the power source 37 can comprise an electric source (e.g., see U.S. application Ser. No. 09/440109) or a hydraulic/pneumatic source supplying either positive pressure (e.g., see U.S. application Ser. No. 08/998528) or negative (suction) pressure source (e.g., see U.S. application Ser. No. 08/998579) to the propulsion subsystem 24. In the case of an electric power source 37, the conduit 35 would include an electric cable. In the case of a hydraulic or pneumatic power source 37, the conduit 35 would comprise a hose for carrying a fluid to or from the propulsion subsystem 24. Unless otherwise stated, it will generally be assumed that the exemplary preferred embodiments described herein use a power source 37 that supplies positive pressure water.

The propulsion subsystem 24 functions to produce a propulsion force $F_P$ directed to propel the body in a forward direction 42 determined primarily by the direction of the force and the orientation of the traction means, i.e., wheels 12A, 12B, 12C. As is well known, because of the intended random travel of automatic pool cleaners and the presence of obstructions (e.g., ladder, steps, etc.) in the pool, a cleaner can get trapped for extended periods as the propulsion force continues to drive the cleaner into an obstruction, e.g., a wall corner. In order to reduce the duration of such trappings, known cleaner systems generally include a timer mechanism for putting the cleaner into a backup state for a limited period.

The system 22 in accordance with the present invention incorporates the aforementioned motion sensor 28 to indicate when the velocity of the body 10 diminishes below a certain threshold rate $V_T$. The indication then prompts the reposition subsystem 26, via controller 30, to generate a repositioning force $F_R$ which repositions the cleaner body 10 enabling the propulsion force $F_P$ to resume body forward motion and random travel through the pool. As will be specifically discussed hereinafter, the controller 30 preferably includes means for periodically defining a conditional repositioning state, e.g., once every 10–60 seconds, having a limited duration of approximately 1 to 60 seconds. The controller is preferably configured so that the repositioning force $F_R$ is generated in response to the motion sensor indication only when a conditional repositioning state is concurrently defined.

Although embodiments of the invention operate to free the cleaner body from obstructions primarily as a result of motion sensor action, the optional timer 32 is preferably provided to periodically reposition the body independent of motion sensor action. That is, the timer 32, which can be readily incorporated as part of the controller 30, periodically defines an unconditional repositioning state, e.g., once every one to five minutes. The unconditional repositioning state activates the reposition subsystem 26 to generate the repositioning force $F_R$, regardless of the body's velocity. This action enhances the randomness of travel of the body through the pool.

The system schematically depicted in FIGS. 1A, 1B contemplates various ways of generating the repositioning force $F_R$, regardless of whether it is powered electrically or by hydraulic/pneumatic positive pressure or negative pressure sources. For example, the force $F_R$ can be generated mechanically, as will be described hereinafter in conjunction with FIGS. 4A, 4B by rotating the body 10 relative to the conduit 35. Alternatively, the force $F_R$ can be generated by various mechanisms which, for example, could differentially drive one or more of wheels 12A, 12B, 12C or steer at least one wheel to thus rotate and/or translate the body. The force $F_R$ can alternatively be generated by discharging a fluid flow (e.g., FIGS. 6A, 7A) in a direction to produce a reaction force to rotate and/or translate (with horizontal and/or vertical components) the body.

Figure 2:
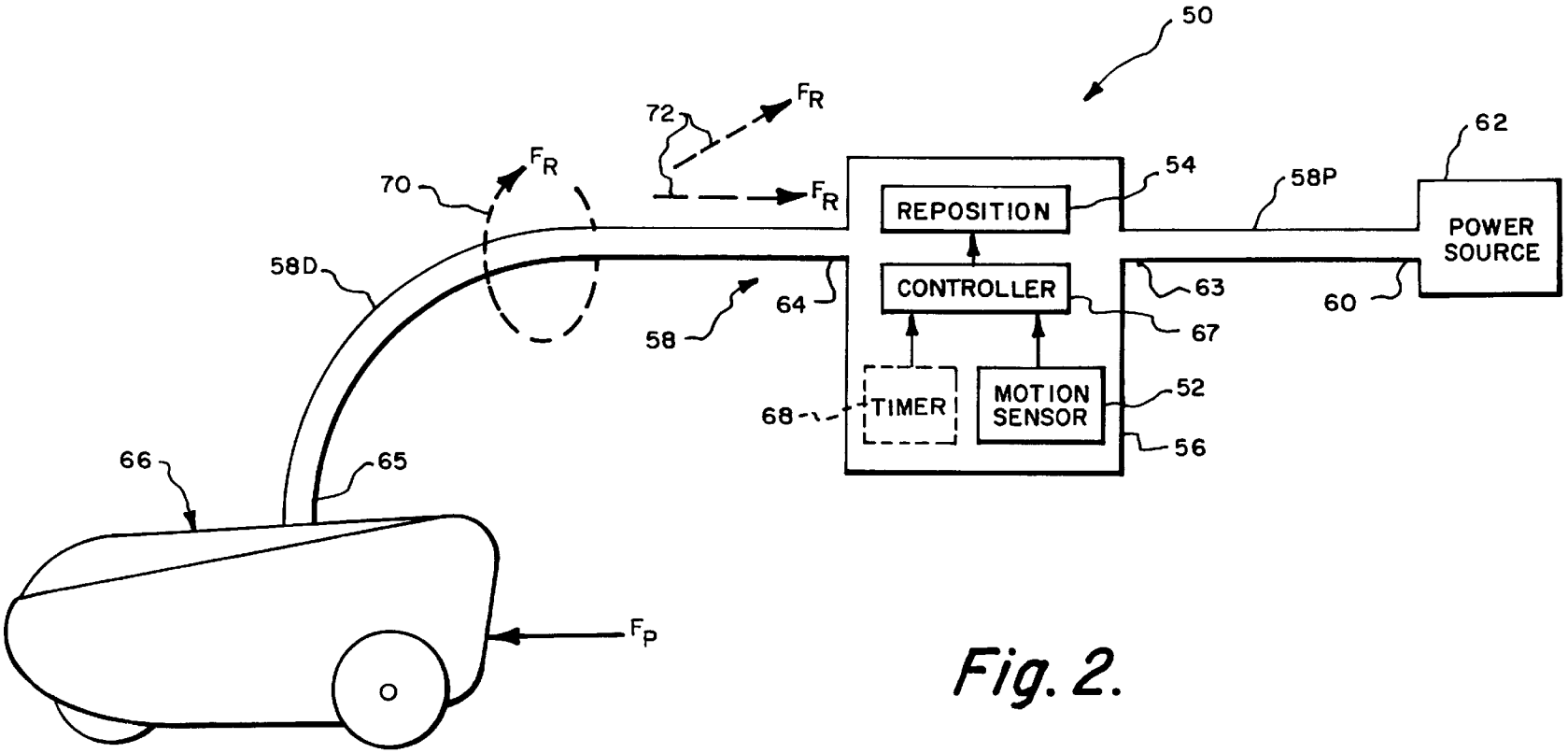
FIG. 2 comprises a side schematic representation of a system in accordance with the invention showing the reposition subsystem carried by the power conduit.

Attention is now directed to FIG. 2 which illustrates a variation of the system schematically depicted in FIGS. 1A, 1B. In FIGS. 1A, 1B, the motion sensor 28 and reposition subsystem 26 are depicted as being carried by the body 10. In the embodiment 50 of FIG. 2, a motion sensor 52 and reposition subsystem 54 are depicted in a housing 56 carried by a conduit 58. More particularly, the housing 56 is intended to be incorporated between a conduit proximal section 58P and a conduit distal section 58D. The proximal section 58P has a first end 60 coupled to a an external pool side power source 62 and a second end 63 coupled to the housing 56. The conduit distal section 58D has a first end 64 coupled to the housing 56 and a second end 65 coupled to a cleaner body 66. The cleaner body 66 includes a propulsion subsystem (not shown) capable of producing a propulsion force $F_P$ driven by power delivered by conduit 58 via housing 56.The propulsion force can be continuously generated or can be interrupted when repositioning subsystem 54 is activated. The motion sensor 52 is shown being coupled to the reposition subsystem 54 via a controller 67. The housing 56 preferably also includes an optional timer 68 corresponding to the aforementioned optional timer 32. The body 66 preferably also contains an optional debris collection means and sweep hose (not shown) similarly to body 10 of FIGS. 1A, 1B. In operation, the body 66 is propelled and drags along the hose 58. The motion sensor 52 indirectly senses the motion of body 66 to control repositioning.

As will be discussed hereinafter in connection with the embodiments depicted in FIGS. 5, 6, and 7, the reposition subsystem 54 operates to apply a force $F_R$ to the conduit distal section 58D. The force can be essentially rotational, i.e., a twisting of the conduit section 58B connected to the body 66, as is represented by force arrow 70. Alternatively, the force $F_R$ can be oriented in a direction having a component extending along conduit section 58D, as is represented by force arrows 72. In either case, the repositioning force $F_R$ will be mechanically transferred through the conduit to reposition the cleaner body 66.

Figure 3A:
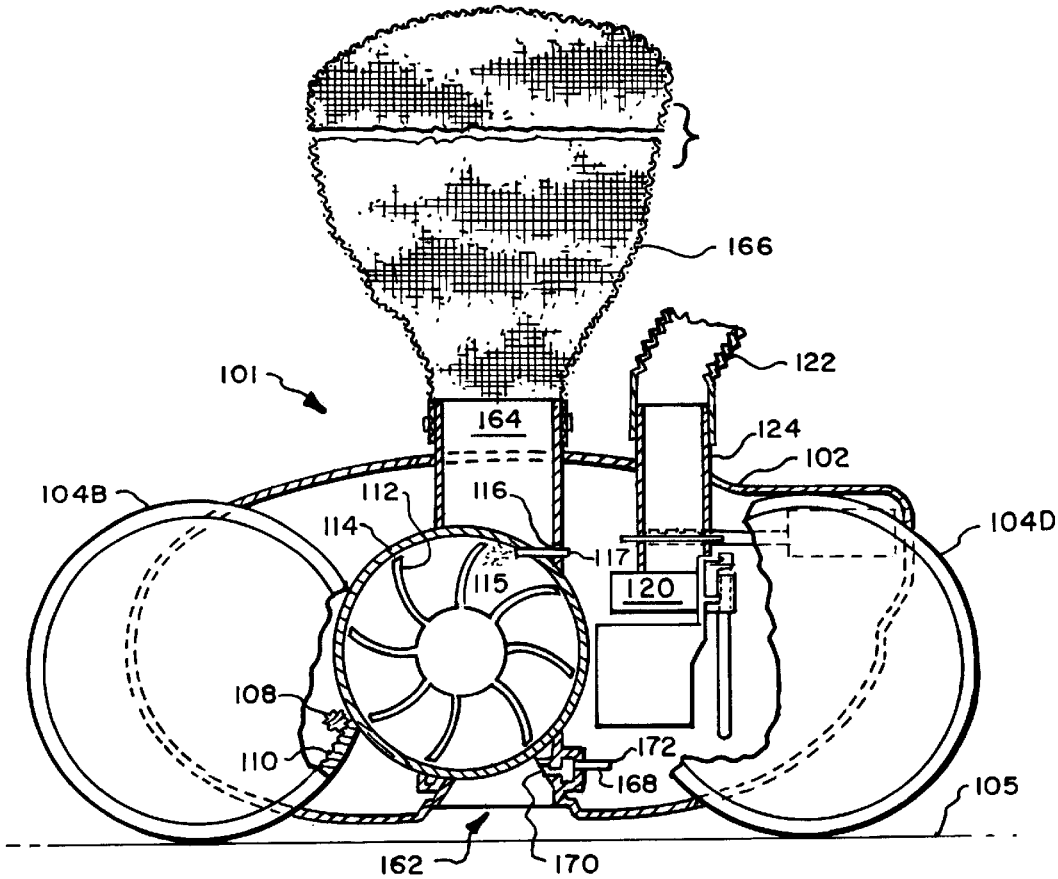
FIGS. 3A and 3B respectively comprise a side sectional view and a top view, partially broken away, of a first embodiment of the invention showing a mechanism located in the cleaner body for rotating the body relative to a supply hose.
Figure 3B:
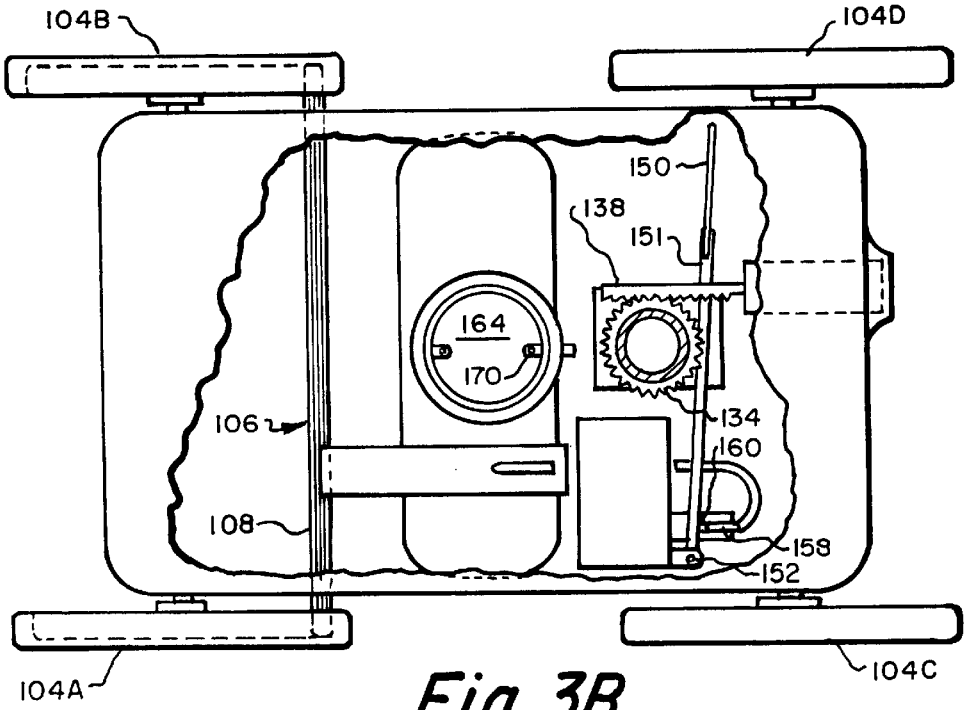

Attention is now directed to FIGS. 3A and 3B which depict a pool cleaner 101 having a body 102 supported on traction wheels 104A, 104B, 104C, and 104D for engaging wall surface 105. Front wheels 104A, 104B are shown as being driven by drive shaft 106 carrying drive gears 108 engaged with annular gears 110 interior to wheels 104A, 104B. Drive shaft 106 is in turn driven by via a gear train (not shown) by turbine 112 mounted for rotation in turbine housing 114. Turbine 112 is rotated by a water stream discharged into housing 114 from the outlet 115 of a turbine nozzle 116. Positive pressure water is supplied to the nozzle inlet 117 from a positive pressure water manifold 120 supplied with positive pressure water from supply hose 122 coupled to a rigid hose connector 124. Hose connector 124 is preferably cylindrical and defines an axis oriented essentially perpendicular to a plane tangent to the wheels 104A, 104B, 104C, and 104D.

The hose connector 124 is aligned with and coupled to a cylindrical tubular member 126 (FIG. 4B) via a swivel seal coupling 128. The coupling 128 is depicted as being comprised of an annular seal 129 and a ball-bearing race 130. The coupling 128 mounts the hose connector 124 for limited rotation about its axis relative to tubular member 126 which is fixed relative to the cleaner body 102. A collar 132 carrying annular gear 134, is fixedly mounted relative to hose connector 124. The gear 134 engages gear teeth 136 formed on rack 138 coupled to a linear actuator 140. As will be discussed hereinafter, actuator 140 can be actuated to selectively move rack 138 to cause a rotation of the body 102 relative to hose connector 124. This rotational action acts to reposition the body, after which forward motion attributable to the driven front wheels 104A and 104B resumes.

FIGS. 3A and 3B also depict a paddle 150 supported on arm 151 mounted to pivot around pin 152. When the body 102 is moving at a forward velocity greater than a threshold rate $V_T$, paddle 150 will pivot clockwise, as viewed in FIG. 3B, to cause arm 151 to engage nipple 158 to close its end or bleed port 160. When the body velocity diminishes below the threshold rate, port 160 opens, as will be discussed in more detail in connection with FIG. 4A, to allow a repositioning action to be initiated.

FIGS. 3A and 3B also illustrate a debris inlet 162 formed on the bottom of the body 102 which opens via vacuum passageway 164 into a debris collection container 166. A jet nozzle 168 has a discharge port 170 mounted proximate to the inlet 162 and directed to discharge into the vacuum passageway 164. Positive pressure water from aforementioned manifold 120 is supplied to the nozzle inlet port 172 to discharge a high velocity stream from port 170 into the vacuum passageway 164 to create a suction adjacent the inlet 162 to draw debris and dirt from adjacent the wall surface 105 for deposit into collection container 166.

Attention is now directed to FIG. 4A which schematically illustrates a preferred control system for the cleaner 101 depicted in FIGS. 3A and 3B. More particularly, FIG. 4A illustrates aforementioned supply hose 122 which delivers positive pressure water to hose connector 124 and then to water manifold 120. The positive pressure water is then delivered from manifold 120 to multiple locations schematically depicted in FIG. 4A. More particularly, positive pressure water is delivered via tube 176 to aforementioned nozzle discharge ports 170 mounted to discharge into the vacuum passage-way 164. Additionally, positive pressure water is delivered from manifold 120 via tube 178 to aforementioned nozzle 116 for discharging the jet 115 for driving the turbine 112 contained in housing 114. (FIG. 3A)

In addition to the foregoing, positive pressure water is delivered from manifold 120 to a controller subsystem 180. More particularly, tube 182 supplies positive pressure water to nozzle 184 located to drive controller turbine 186. Turbine 186 is mounted on and rotates shaft 188 which, via gear box 190, rotates a controller disk 192. Disk 192 is mounted for rotation in a controller housing 194 intended to be sealed against the housing of gear box 190. Positive pressure water is supplied to the controller housing 194 from manifold 120 via tube 195.

The controller housing 194 includes an apertured controller base plate 196, shown enlarged in FIG. 4A2. The base plate 196 contains apertures within a circular area 198 which, as will be discussed hereinafter, is overlaid by the controller disk 192. The apertures in base plate 196 include drive ports 200 and 202, displaced by about 202° around the circumference of circular area 198. Spaced radially inwardly from the drive ports 200 and 202, respectively, are elongate relief ports 204 and 206.

The controller disk 192, shown enlarged in FIGS. 4A3, 4A4, is mounted on shaft 188 for rotation in controller housing 194 overlaying base plate 196. The controller disk 192 is apertured to periodically open and close the ports in base plate 196 as the disk 192 rotates. The controller disk 192 includes a plurality of through holes 210, extending from a disk front face 211 to a rear face 212. The through holes 210 are uniformly spaced around the circumference of controller disk 192. FIG. 4A3 shows eight through holes 210, each displaced by 45° from its adjacent through hole. Disk 192 also defines a plurality of bridge slots 214 which extend only partially into the disk from the disk rear face 212 toward the disk front face 211. The bridge slots 214 are elongate and radiate outwardly from the rotational axis defined by shaft 188. As can be seen in FIG. 4A3, the elongate bridge slots 214 are located between the through holes 210.

As the controller disk 192 rotates, when a through hole 210 overlays the drive port 200, positive pressure water is supplied through the drive port 200 to tube 220. Similarly, when a through hole 210 overlays drive port 202, positive pressure water is supplied to tube 222. When a bridge slot 214 aligns with drive port 200, it acts to couple drive port 200 and relief port 204. Similarly, when a bridge slot 214 aligns with drive port 202, it couples drive port 202 and relief port 206. Relief port 206 is coupled to tube 224 which is open to the pool water. Relief port 204 extends via tube 226 to the aforementioned nipple 158 defining bleed port 160. It will be recalled from the description of FIGS. 3A and 3B that paddle arm 151 acts to close the bleed port 160 when the forward velocity of body 102 exceeds a threshold rate $V_T$. If the body velocity is less than $V_T$, then the arm 151 is able to pivot to allow bleed port 160 to open.

The aforementioned drive port 200 in controller base plate 196 is coupled via tube 220 to a first control port 230 of linear actuator 140. Drive port 202 is coupled via tube 222 to a second control port 232 of linear actuator 140. The linear actuator 140 includes an internal piston 234 mounted for movement within the actuator housing. That is, when positive pressure water is supplied to control port 230 and control port 232 is open to the pool water, the piston 234 will be driven to the right as viewed in FIG. 4A. Conversely, when positive pressure water is supplied to control port 232 and control port 230 is open to the pool water, the piston 234 will be driven to the left. The aforementioned rack 138 is secured to piston 234 and moves linearly with the piston.

In operation, the positive pressure water from manifold 120 drives the turbine 112 to drive the front wheels 104A, 104B to propel the body 102 in a forward direction. When moving in a forward direction at a greater than threshold rate $V_T$, paddle 150 and arm 151 will act to close bleed port 160 of nipple 158. The positive pressure water supplied by manifold 120 will also drive controller turbine 186 via nozzle 184. This will rotate controller disk 192 in housing 194. The controller disk 192 will periodically align a through hole 210 with drive port 200. This will supply positive pressure water to actuator control port 230. Note that when a through hole 210 is aligned with drive port 200, a bridge slot 214 is aligned with drive port 202 and relief port 206. Thus, when positive water pressure is supplied via drive port 202 to actuator control port 230, control port 232 is relieved via port 202, bridge slot 214, and relief port 206. Even though a through hole 210 periodically aligns with drive port 202 to define a conditional repositioning state, so long as body velocity is greater than threshold $V_T$, the positive pressure available at actuator control port 232 cannot move piston 234 to the left because the bleed port 160 is closed by the motion sensor arm 151.

Now assume that the velocity of the cleaner body diminishes below the threshold rate $V_T$ which eliminates the force on the paddle 150 holding the arm 151 against bleed port 160. When this occurs, the next time a through hole 210 aligns with drive port 202, positive water pressure is supplied to actuator control port 232. Simultaneously, control port 230 becomes open to the pool as a consequence of a bridge slot 214 bridging ports 200 and 204. Recall that port 204 extends via tube 226 to bleed port 160, which can now open because the body velocity is no longer forcing the paddle to close the port. This permits the positive pressure on control port 232 to move the piston 234 to the left, as viewed in FIG. 4A1, correspondingly moving the rack 138.

Figure 4B:
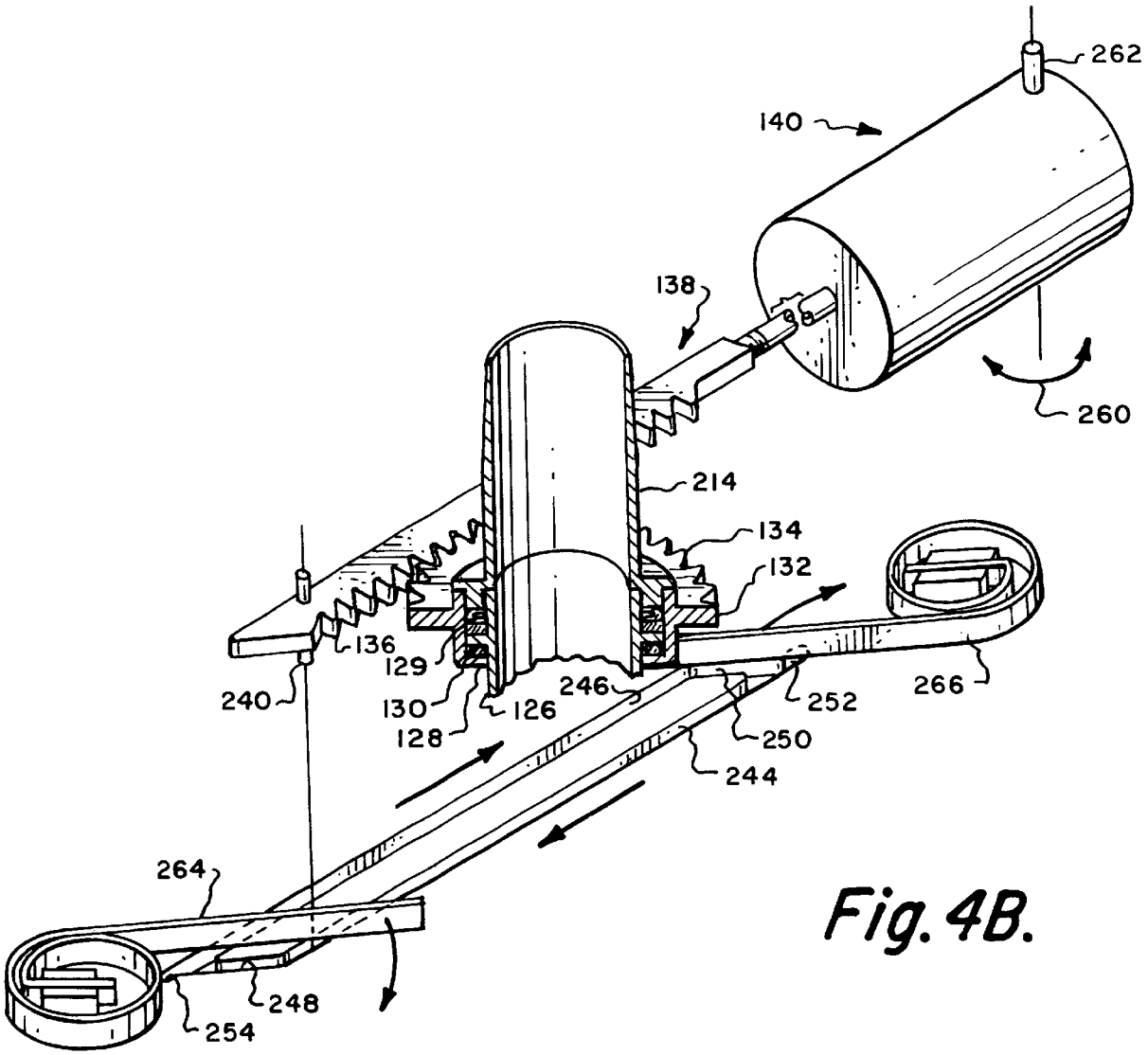

Movement of the rack 138, as aforedescribed, is able to rotate the body relative to the hose connector 124 which is connected to a relatively torsionally stiff distal hose section 122. In accordance with the preferred embodiment as depicted in FIGS. 4B and 4C1, 4C2, 4C3, and 4C4, the rack 138 is configured to engage the gear 134 only when moving in one direction, i.e., right to left as illustrated. More particularly, rack 138 carries end pin 240 positioned to move within a track 242 having an essentially parallelogram shape. The track 242 defines first and second parallel elongate track sections 244 and 246. The sections 244 and 246 are bridged by ramp sections 248 and 250. A detent track area 252 is defined between ramp section 250 and track section 244. An additional detent track area 254 is defined between track section 246 and ramp section 248. Note in FIG. 4C1, the rack 138 is positioned to the right with the rack end pin 240 in detent area 252. If positive pressure water is now supplied to actuator control port 232 to define a conditional repositioning state and if concurrently the body velocity is below threshold so that bleed port 160 can open, then the actuator piston 234 and rack 138 will move to the left with pin 240 traveling along track section 244. As a consequence of the engagement between rack 138 and gear 134, the body 102 will rotate relative to the hose connector 124. When the rack pin 240 reaches the left end of the track 244, it will move up ramp 248 toward detent area 254. With the rack pin 240 in detent area 254, the rack 138 is disengaged from the gear 134 (FIG. 4C3). The rack 138 will remain disengaged as it is pulled to the right, as depicted in FIG. 4C4. Pin 240 will travel along track section 246 and then traverse ramp 250 back to its starting position depicted in FIG. 4C1, ready to then again engage rack 138 and gear 134.

In order to permit the rack pin 240 to traverse the parallelogram track 242 to alternately move the rack 138 into and out of engagement with gear 134, the actuator 140 is mounted for limited swivel movement, represented by arrows 260, about pin 262 (FIG. 4B). Springs 264 and 266 are respectively mounted near ramps 248 and 250 to engage the rack 138 to hold pin 240 in the track and assist in guiding it into the respective detent areas 252 and 254.

Figures 5A, 5B:
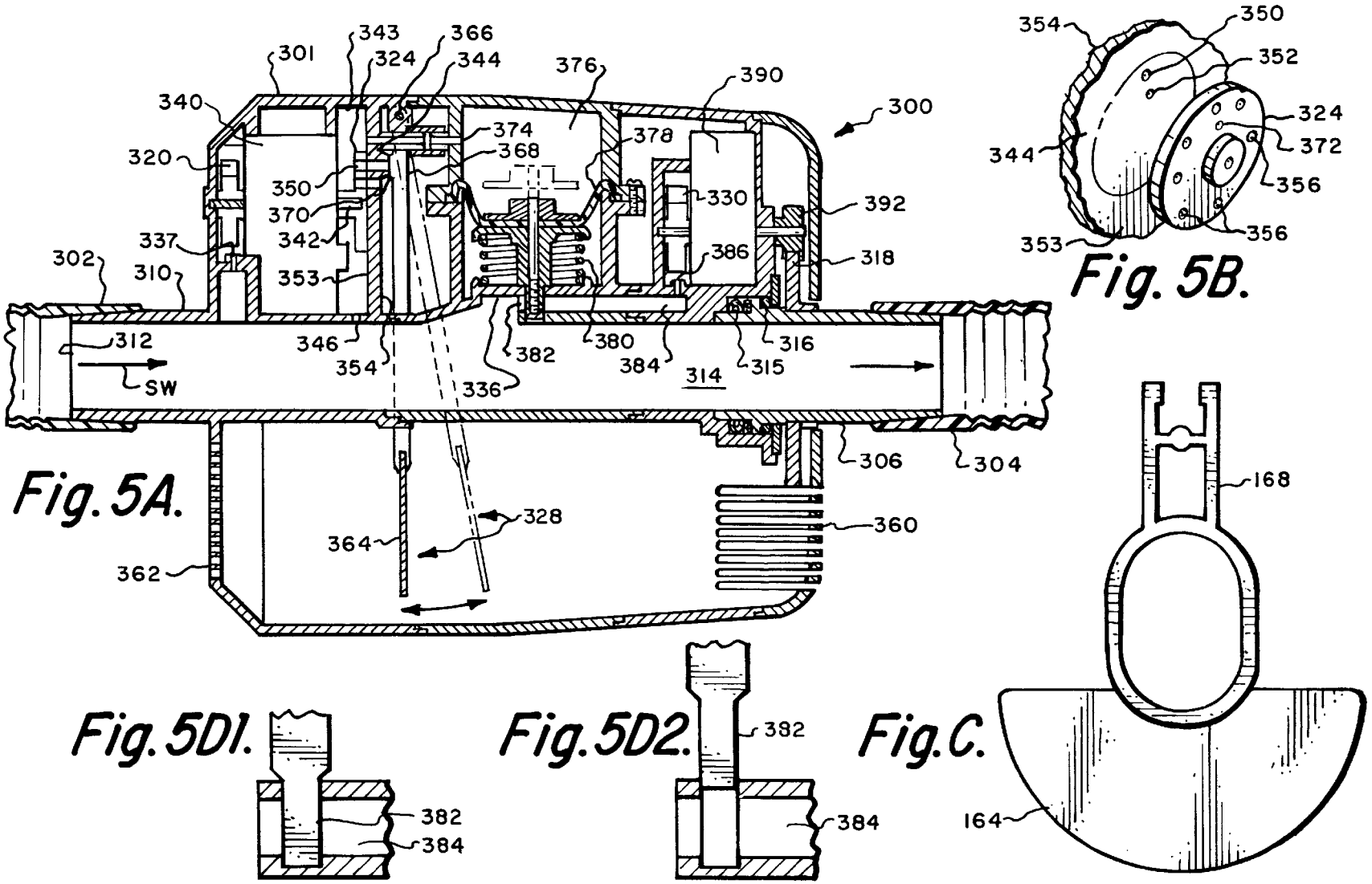

Attention is now directed to FIG. 5A which illustrates an embodiment 300 for use in a system of the type depicted in FIG. 2. The embodiment 300 includes a housing 301 to be mounted between a proximal hose section 302 extending toward a power source, e.g. a pump supplying a positive pressure water flow, and a distal hose section 304 connected to a cleaner body. The embodiment 300, as will be described hereinafter, embodies essentially the same functionality of the embodiment of FIGS. 3 and 4. That is, it responds to the velocity of housing 301 moving at less than a threshold $V_T$ to reposition the cleaner body. Repositioning is accomplished by rotating or twisting hose fitting 306 about its axis, relative to housing 301. Housing 301 is fixedly secured to hose section 302. More particularly, the housing 301 includes a mechanism which responds to velocity being less than $V_T$ to produce a force to twist hose fitting 306 to in turn twist hose section 304. The hose section 304 is selected to have sufficient torsional rigidity so that it in turn acts to twist, and thus reposition, the cleaner body.

Housing 301 forms an axially projecting hose fitting 310 defining an entrance 312 opening into pathway 314 for carrying supply water flow $S_W$. The fitting 310 is intended to be fixedly secured to hose section 302. The pathway 314 exits into hose fitting 306 which is mounted by seal 315 and ball bearing race 316 enabling it to twist or swivel about its axis relative to housing 301. A twisting force is produced on fitting 306, as will be described hereinafter, via gear 318.

Housing 301 basically includes a timing turbine 320 for driving a periodic disk 324, a paddle motion sensor 328 for sensing velocity, a repositioning turbine 330 for driving the aforementioned repositioning gear 318, and a valve mechanism 336 for responding to the periodic disk 324 and motion sensor 328 to selectively drive turbine 330 to twist fitting 306.

Timing turbine 320 is driven via a water stream discharged from nozzle 337 which is supplied from pathway 314. Turbine 320, via gear box 340, drives shaft 342 carrying periodic disk 324. Disk 324 is mounted in chamber 343 and overlays and rotates on base plate 344. Water under pressure is supplied to chamber 343 from pathway 314 via aperture 346.

As shown in FIGS. 5A and 5B, base plate 344 defines ports 350 and 352 both extending through the base plate from a front face 353 adjacent chamber 343 to a rear face 354 which is open to pool water. Disk 324 defines a plurality of through holes 356 spaced around the periphery and placed to successively align with base plate port 350. As will be seen, a conditional repositioning state is defined whenever a hole 356 aligns with port 350. Port 350 will be open if the velocity of housing 301 through the water is less than a threshold $V_T$. If the velocity is greater than $V_T$, then water entering the housing through slots 360 and leaving the housing through openings 362 will act on paddle 364 to pivot it clockwise around pin 366 to the full line position shown in FIG. 5A. Paddle 364 is carried by arm 368 having a protuberance 370 positioned to seal against port 350 at rear face 354.

Disk 324 also defines a single through hole 372 positioned radially inward of holes 356. Through hole 372 aligns with base plate port 352 once per cycle of disk 324 to define an unconditional repositioning state opening chamber 343 to the pool water.

A pathway 374 communicates chamber 343 to valve assembly chamber 376. Chamber 376 includes a diaphragm 378 biased by spring 380. When chamber 376 is pressurized, diaphragm 378 moves downward to compress spring 380 and close valve 382 thereby closing pathway 384 to the supply water pathway 314 (FIG. 5D1). When pressure is relieved in valve chamber 376, spring 380 moves diaphragm 378 upward and opens valve 382 (FIG. 5D2). This action supplies water pressure from supply pathway 314 to nozzle 386, via pathway 384. The discharge from nozzle 386 drives aforementioned turbine 330 which, via gear train 390, rotates gear 392 to drive aforementioned gear 318 fixed to hose fitting 306.

In operation, first assume that the housing 301 is being towed by the cleaner body as depicted in FIG. 2, at a velocity above threshold $V_T$ so that paddle arm 368 closes port 350. With port 350 closed and with port 352 closed by disk 324, chamber 343 will be pressurized. Moreover, chamber 376 will also be pressured through open pathway 374. This action will compress spring 380 and close valve 382. Thus, reposition turbine 330 is not driven. Periodically, disk 324 will align a hole 356 with port 350 but this conditional reposition state will be ignored so long as paddle arm 368 holds port 350 closed. However, once per disk cycle, hole 372 aligns with port 352. This action vents the pressure from chamber 343 and chamber 376 allowing spring 380 to open valve 382. As a consequence, water is supplied from pathway 314 to nozzle 386 to drive reposition turbine 330. The result of this action is to rotate or twist fitting 306 and hose section 304 to reposition the cleaner body.

If the cleaner body became obstructed so that the velocity of housing 301 diminished and allowed paddle arm 366 to open port 350, then as soon as the next hole 356 aligned with port 350, pressure would be relieved in chambers 343 and 376. This action would open valve 382 to cause nozzle 386 to drive reposition turbine 330 to rotate fitting 306.

Attention is now directed to FIGS. 6A, 6B1, 6B2 which illustrate an embodiment 400 quite similar to the embodiment of FIGS. 5A, 5B, 5C. However instead of repositioning the cleaner body by twisting the distal hose section, the embodiment of FIG. 6 repositions the cleaner body by discharging a water stream 406 via pathway 408. More particularly, valve assembly 410, mounted in housing 411 can be identical to valve assembly 336 of FIG. 5A, for controlling valve 412. When the valve assembly spring 414 is compressed, valve 412 closes pathway 408 (FIG. 6B2) and directs the primary water flow 416 out through passage 417 to fitting 418 to the distal hose section. On the other hand, when spring 414 is expanded, valve 412 closes passage 417 and opens pathway 408 (FIG. 6B1) to discharge water stream 406 to produce a force $F_R$ having a component extending substantially along the distal hose section, as shown at 72 in FIG. 2. This force $F_R$ essentially acts to tug the distal hose section to reposition the cleaner body.

Attention is now directed to FIGS. 7A, 7B, 7C1, 7C2 which illustrate a further embodiment 500 which is similar to the embodiment of FIG. 6 in that it selectively discharges a water stream 506 via pathway 508 to produce a repositioning force $F_R$.

More particularly, embodiment 500 includes housing 510 defining a proximal inlet hose fitting 512 and distal outlet hose fitting 514. A supply water pathway 516 extends between the hose fittings 512 and 514. An inlet port 518 to repositioning pathway 508 communicates with supply pathway 516. A disk valve 520 is mounted for rotation adjacent to inlet 518 for transitioning between a (1) normal state (FIG. 7C2) which closes inlet port 518 and opens pathway 516 to outlet hose fitting 514 and a (2) repositioning state (FIG. 7C1) which opens inlet port 518 and blocks outlet fitting 514.

Note that disk valve 520 is mounted for rotation about axis 522 and defines an opening 524 and an axially extending peripheral valve surface 526. In the normal state, the disk valve 520 overlays inlet port 518 to thus direct the supply flow 527 out through distal fitting 514. In the repositioning state (FIG. 7C1), valve disk opening 524 aligns with inlet port 518 and valve surface 526 blocks pathway 516 to fitting 514 to thus direct supply water flow 527 out through pathway 508.

The embodiment 500 includes a turbine 540 driven by nozzle 542 supplied via tube 543 from water pathway 516. The turbine 540 is configured to drive the disk valve 520 via a gear train 541 including a clutch or throw-out mechanism 544. The clutch mechanism 544 (FIG. 7B) is controlled by motion sensor paddle 546. Paddle 546 is biased clockwise around pin 547 by spring 548. As long as the housing 510 velocity exceeds the threshold $V_T$, pool water exerts a force $F_W$ on paddle 546 to pivot it counterclockwise (FIG. 7B) around pin 547. This action disengages the drive to disk valve 520 which thus remains in the normal (FIG. 7C2) state with fitting 514 open and port 518 closed. However, if the housing velocity diminishes below $V_T$, then the spring 546 pivots paddle 546 clockwise to engage the gear drive coupling turbine 540 to disk valve 520. This action will rotate disk valve 520 to move it through the reposition state depicted in FIG. 7C1. This action will open port 518 and closefitting 514 for a limited duration. The mechanism 544 is preferably configured so that it periodically, e.g., once every 5 minutes, engages regardless of housing velocity as a consequence of cam 552 lifting arm 554 (FIG. 7B). This feature enhances the randomness of travel of the cleaner body.

From the foregoing, it should now be appreciated that multiple embodiments have been described herein for propelling a cleaner body through a water pool while monitoring the body velocity to initiate a repositioning action. The repositioning action involves generating a force for a limited duration to reposition the cleaner body. After the repositioning duration, the cleaner body then resumes forward travel. Embodiments of the present invention are applicable to a wide variety of pool cleaning systems. Such systems can include a cleaner body which is restricted to underwater travel proximate to a wall surface, restricted to water surface travel, or which can operate selectively either underwater at the wall surface or at the water surface.

It is recognized that although several exemplary embodiments of the invention have been specifically described herein, many other variations and alternatives will occur to those skilled in the art. Accordingly, it is intended that the appended claims be interpreted to encompass all such variations and alternatives falling within the spirit and scope of the invention.

What is claimed is:

1. A swimming pool cleaner comprising:

a cleaner body;

a propulsion generator operable to produce a force for propelling said body in a forward direction;

a motion sensor operable to indicate when said body fails to move at a rate exceeding a certain threshold; and repositioning means responsive to said motion sensor indication for producing a force for a limited duration to reposition said body; and whereby said propulsion generator after said limited duration causes said body to resume travel in said forward direction.

2. The cleaner of claim 1 wherein said repositioning means is located on said body.

3. The cleaner of claim 1 further including a flexible conduit connected to said body for supplying power thereto.

4. The cleaner of claim 3 wherein said repositioning means is carried by said conduit.

5. The cleaner of claim 3 wherein said conduit comprises a hose connected to said body for carrying a supply water flow to or from an external pump; and wherein said supply water flow powers said propulsion generator to produce said propelling force.

6. The cleaner of claim 3 wherein said conduit comprises a hose connected to said body for carrying a supply water flow to or from an external pump; and wherein said supply water flow powers said repositioning means to produce said repositioning force.

7. The cleaner of claim 3 wherein said conduit supplies electric power to said body.

8. The cleaner of claim 3 wherein said conduit supplies a positive pressure fluid flow to said body.

9. The cleaner of claim 3 wherein said conduit carries a negative pressure fluid flow from said body.

10. The cleaner of claim 1 wherein said repositioning means includes means for discharging a fluid flow for producing said force to reposition said body.

11. The cleaner of claim 10 wherein said repositioning means is located on said body.

12. The cleaner of claim 10 wherein said repositioning means is located on said conduit.

13. The cleaner of claim 1 wherein said repositioning means includes means for mechanically producing said force to reposition said body.

14. The cleaner of claim 13 wherein said repositioning means is located on said body.

15. The cleaner of claim 13 wherein said repositioning means is located on said conduit.

16. The cleaner of claim 1 further including a controller for periodically defining a limited duration conditional repositioning state; and wherein said repositioning means produces said force when said motion sensor indication and said conditional repositioning state occur concurrently.

17. The cleaner of claim 1 further including a controller for periodically defining a limited duration unconditional repositioning state; and wherein said repositioning means produces said force responsive to said controller defining said unconditional repositioning state.

18. The cleaner of claim 1 further including a sweep hose carried by said body.

19. The cleaner of claim 1 further including debris collection means carried by said body.

20. An automatic swimming pool cleaning system comprising:

a cleaner body;

a propulsion subsystem operable to produce a force for propelling said body in a forward direction;

a motion sensor operable to indicate when said body velocity is below a certain threshold rate; and a repositioning subsystem responsive to said motion sensor indication for producing a force of limited duration to reposition said body, said propulsion subsystem operable after said limited duration to cause said body to resume travel in said forward direction.

21. The system of claim 20 further including a conduit having a first end connected to said body for supplying power thereto.

22. The system of claim 21 wherein said conduit supplies power to said propulsion subsystem and/or said repositioning system.

23. The system of claim 21 wherein said repositioning subsystem includes a mechanism operable to produce a force for rotating said body.

24. The system of claim 23 therein said mechanism is operable to twist said conduit first end to rotate said body.

25. The system of claim 23 wherein said mechanism is operable to rotate said body relative to said conduit first end.

26. The system of claim 20 wherein said repositioning subsystem includes means for discharging a fluid flow for producing a force to reposition said body.

27. The system of claim 26 wherein said fluid flow is discharged from a location on said body to rotate and/or translate said body.

28. The system of claim 26 further including a conduit having a first end connected to said body for supplying power thereto; and wherein said fluid flow is discharged from a location on said conduit.

29. The system of claim 28 wherein said fluid flow is discharged in a direction along said conduit to translate said body.

30. It The system of claim 20 further including a conduit comprised of a proximal section adapted for connection to a power source and a distal section adapted for connection to said body; and a housing coupling said proximal section to said distal section, said housing containing said motion sensor and said repositioning subsystem.

31. The system of claim 20 further including a controller for periodically defining a limited duration conditional repositioning state; and wherein said repositioning subsystem produces said force when said motion sensor indication and said conditional repositioning state occur concurrently.

32. The system of claim 20 further including a controller for periodically defining a limited duration unconditional repositioning state; and wherein said repositioning subsystem produces said force responsive to said controller defining said unconditional repositioning state.

33. The system of claim 20 further including an electric power source; and an elongate flexible conduit connecting said power source to said body for powering said propulsion subsystem and/or said repositioning subsystem.

34. The subsystem of claim 20 further including a fluid power source; and an elongate flexible hose connecting said body for supplying positive pressure fluid for powering said propulsion subsystem and/or said repositioning subsystem.

35. The system of claim 20 further including a fluid power source; and an elongate flexible hose connecting said power source to said body for pulling fluid therefrom for powering said propulsion subsystem and/or repositioning subsystem.

36. An automatic swimming pool cleaning system including:

a power source adapted to be mounted externally of a water pool contained by a containment wall;

a cleaner body adapted for use in said water pool;

a propulsion subsystem carried by said cleaner body for producing a force for propelling said body in a forward direction;

an elongate conduit having a first end connected to said power source and a second end connected to said cleaner body for supplying power to said propulsion subsystem to propel said body in said forward direction to randomly traverse said pool;

a motion sensor for indicating when the forward velocity of said body is below a threshold; and a repositioning subsystem actuatable in response to said motion sensor indication for producing a force of limited duration to reposition said body prior to said body resuming travel in said forward direction.

37. The system of claim 36 wherein said repositioning subsystem produces a force having directional components to rotate and/or translate said body.

38. The system of claim 36 further including a controller for periodically defining a conditional repositioning state; and wherein said repositioning subsystem is actuatable in response to said motion sensor indication occurring coincident with said conditional repositioning state.

39. The system of claim 36 further including a timer for periodically defining an unconditional repositioning state to actuate said repositioning subsystem independent of said motion sensor.

40. The system of claim 36 further including debris collection means carried by said body.

41. The system of claim 36 further including a sweep hose carried by said body.

42. The system of claim 36 wherein said repositioning subsystem is mounted on said body.

43. The system of claim 36 wherein said repositioning subsystem is mounted on said conduit.

44. The system of claim 36 wherein said conduit includes a proximal section having one end connected to said power source and a distal section having one end connected to said body; and wherein said repositioning subsystem is mounted between said proximal and distal sections.

45. A method of operating a swimming pool cleaner body to enable it to randomly traverse a swimming pool comprising the steps of:

propelling said cleaner body to move it in a forward direction;

sensing the velocity of said body;

responding to the velocity of said body diminishing below a certain threshold for generating a force to reposition said body;

terminating said force after a short duration to permit said body to resume movement in said forward direction.

46. The method of claim 45 wherein said step of generating a force includes mechanically rotating a member carried by said body.

47. The method of claim 45 wherein said step of generating a force includes discharging a fluid stream.

* * * * *